United States Patent [19]

Suzuki

[11] Patent Number: 5,018,206

[45] Date of Patent: May 21, 1991

[54] NETWORK MOUNTING DEVICE FOR COAXIAL TYPE SPEAKER

[75] Inventor: Takashi Suzuki, Yamagata, Japan

[73] Assignee: Pioneer Electronic Corp., Tokyo, Japan

[21] Appl. No.: 489,156

[22] Filed: Mar. 6, 1990

[30] Foreign Application Priority Data

Sep. 14, 1989 [JP] Japan ..... 1-107229[U]

[51] Int. Cl.[5] ..... H04R 1/02

[52] U.S. Cl. ..... 381/188; 381/195; 381/205; 381/88; 381/90

[58] Field of Search ..... 381/87, 88, 90, 99, 381/100, 116, 117, 182, 186, 188, 192, 199, 200, 201, 205; 340/384 E

[56] References Cited

U.S. PATENT DOCUMENTS 2,949,663 8/1960 Perry ..... 381/199
4,365,114 12/1982 Soma ..... 381/182
4,520,237 5/1985 Murakami ..... 381/199
4,654,486 3/1987 Adolph ..... 381/201
4,821,331 4/1989 Murayama ..... 381/182
4,973,941 11/1990 Davis et al. ..... 381/90

*Primary Examiner*—Forester W. Isen
*Assistant Examiner*—Steven P. Fallon
*Attorney, Agent, or Firm*—Sughrue, Mion, Zinn, Macpeak & Seas

[57] ABSTRACT

A network mounting device in a coaxial type speaker including a woofer having a diaphragm, a center pole for forming a magnetic circuit of the woofer, and a tweeter mounted on a front end of the center pole. The network mounting device includes a frame for supporting an outer circumference of the diaphragm of the woofer, a plate for forming the magnetic circuit, a network for dividing a frequency and feeding divided frequencies to the woofer and the tweeter, and a substrate for mounting the network thereon, which substrate is sandwiched between the frame and the plate. The coaxial type speaker can be assembled easily, and the workability for wiring of the network can be improved.

5 Claims, 2 Drawing Sheets

NETWORK MOUNTING DEVICE FOR COAXIAL TYPE SPEAKER

BACKGROUND OF THE INVENTION

The present invention relates to a device for mounting a network for dividing a frequency and feeding divided frequencies to a woofer and a tweeter in a coaxial type composite speaker wherein the tweeter is coaxially mounted on the front side of the woofer.

Conventionally in such a coaxial type composite speaker as mentioned above, it is general that the network is integrally mounted to the speaker.

FIG. 3 is a vertical sectional view of an example of the prior art coaxial type speaker. Referring to FIG. 3, a tweeter 1 is mounted on a front end of an extension 4 of a center pole 3 for forming a magnetic circuit of a woofer 2. A magnet cover 5 is provided to cover the magnetic circuit of the woofer 2, and network parts such as a choke coil 6 and a capacitor are mounted in the magnet cover 5.

FIG. 4 is a view similar to FIG. 3, showing another example of the prior art coaxial type speaker. Referring to FIG. 4, a bobbin 8 for winding the choke coil 6 is mounted through a spacer 7 to the center pole 3 of the woofer 2, and the tweeter 1 is mounted on the bobbin 8.

In the former example shown in FIG. 3, as the network is mounted in the magnet cover 5, the magnet cover is necessary in addition to a substrate on which the choke coil 6, the capacitor, etc. are soldered, thus causing an increase in cost. Futhermore, after the tweeter 1 and the woofer 2 are assembled together, the magnet cover 5 installing the network is mounted, and a wiring from the network to a voice coil is connected, thus reducing the workability.

In the latter example shown in FIG. 4, the bobbin 8 winding the choke coil 6 therearound must be mounted in assembling the tweeter 1 and the woofer 2, and a wiring from the choke coil 6 to the capacitor and the voice coil is connected. Accordingly, there are problems in ensuring of a wiring path, assembling, workability for wiring, etc.

SUMMARY OF THE INVENTION

It is an object of the present invention to improve the assembling of the coaxial type speaker and the workability for wiring of the network.

According to the present invention, there is provided in a coaxial type speaker including a woofer having a diaphragm, a center pole for forming a magnetic circuit of said woofer, and a tweeter mounted on a front end of said center pole; a network mounting device comprising a frame for supporting an outer circumference of said diaphragm of said woofer, a plate for forming said magnetic circuit, a network for dividing a frequency and feeding divided frequencies to said woofer and said tweeter, and a substrate for mounting said network thereon, said subtrate being sandwiched between said frame and said plate.

The plate for forming said magnetic circuit of said woofer may be formed at its central portion with a reamed hole so as to define a magnetic gap between said center pole and said plate, any may be formed at its annular portion around said central portion with a plurality of dowel pins projecting from a front surface of said plate.

The frame and the subtrate may be formed with central holes adapted to be aligned to said reamed hole of said plate, and may also be formed with a plurality of engagement holes adapted to be engaged with said plural dowel pins of said plate.

The frame may be formed at its annular portion with a plurality of window openings and a plurality of radially extending parting portions for parting said window openings.

The dowel pins of said plate may be caulked to said frame.

With the above construction, the substrate on which the network is mounted can be sandwiched between the plate and the frame at the same time when the plate for forming the magnetic circuit is caulked to the frame for supporting the outer circumference of the diaphragm, thus eliminating a special step for mounting the network and thereby improving the workability.

As the mounting space for the substrate is not relatively limited, the number of circuit devices to be mounted on the subtrate can be increased, and a complex circuit such as a network having a steep division characteristic can be formed.

Futhermore, as the substrate can be utilized as an input terminal for receiving an external signal, an input terminal conventionally mounted to the frame can be eliminated.

Other objects and features of the invention will be more fully understood from the following detailed description and appended claims when taken with the accompanying drawings.

DETAILED DESCRIPTION OF THE PREFERRED EMBODIMENT

Figure 1:
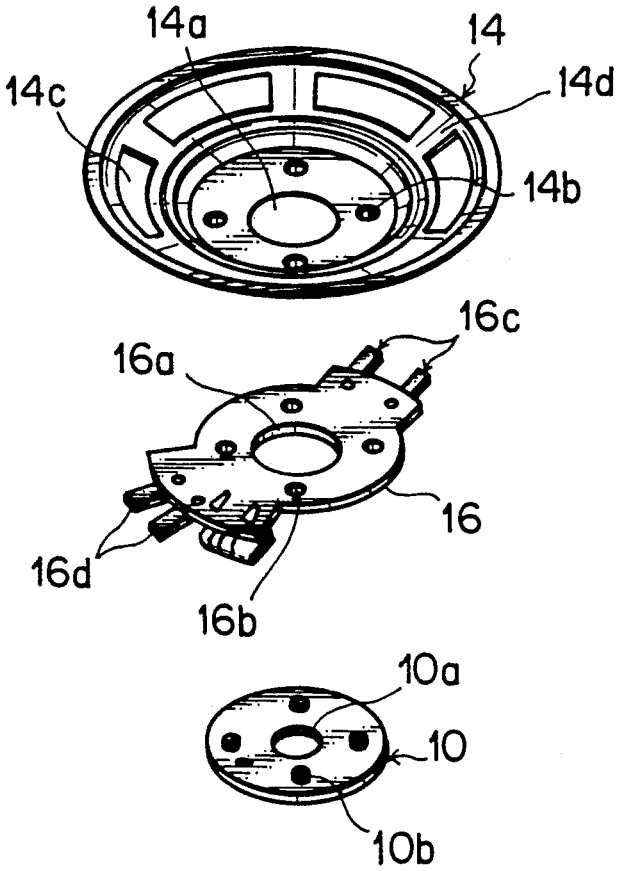
FIG. 1 is an exploded perspective view of an essential part of a preferred embodiment of the present invention.
Figure 2:
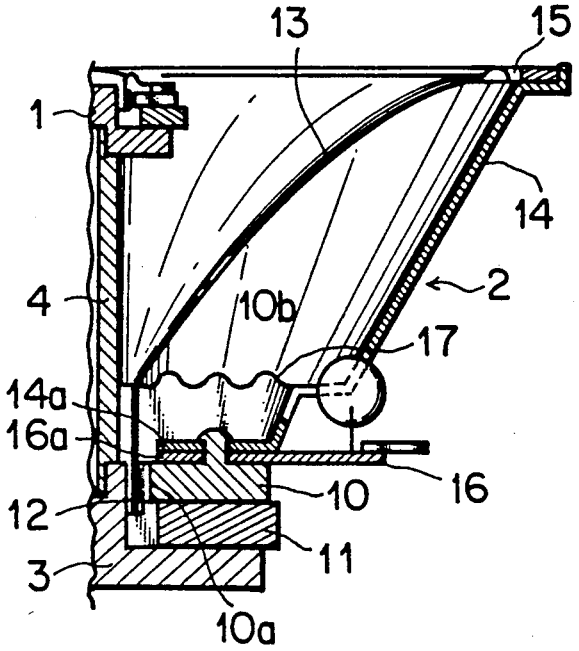
FIG. 2 is a vertical sectional view of FIG. 1.
Figure 3:
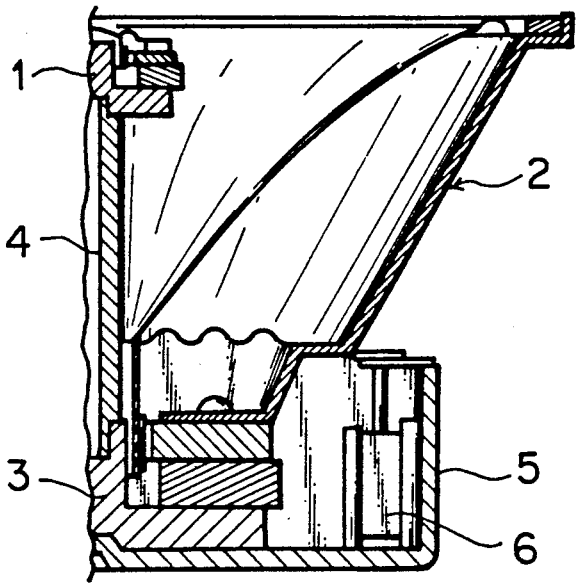
FIG. 3 PRIOR ART
FIGS. 3 and 4 are vertical sectional views of the coaxial type speaker in the prior art.
Figure 4:
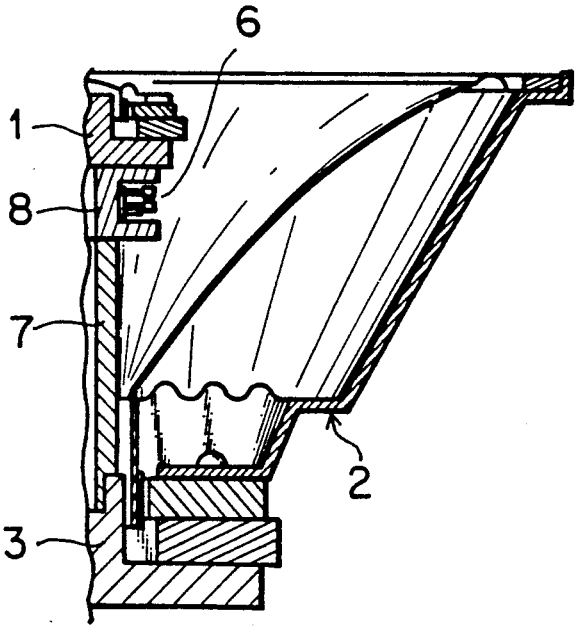
FIG. 4 PRIOR ART

Referring to FIGS. 1 and 2 which show a preferred embodiment of the present invention, reference numeral 10 designates a circular plate for forming a magnetic circuit of the woofer 2. A magnetic gap is formed between the plate 10 and the center pole 3 by a magnet 11. A voice coil 12 inserted in the magnetic gap is driven by the plate 10 to vibrate a bass diaphragm 13.

The circular plate 10 is formed at its central portion with a reamed hole **10*a* for forming the magnetic gap between the same and the center pole 3. The circular plate 10 is further formed at its annular portion around the central reamed hole 10*a* with a plurality of dowel pins 10*b* projecting from an upper surface of the plate 10**.

Reference numeral 14 designates a frame for supporting an outer circumference of the diaphragm 13 through an edge 15. The frame 14 has a frustoconical shape such that it is diverged upwardly as shown in FIGS. 1 and 2. The frustoconical frame 14 is formed at its central portion with a hole **14*a* adapted to be aligned to the reamed hole 10*a* of the plate 10. The frustoconical frame 14 is further formed at its bottom portion around the central hole 14*a* with a plurality of engagement holes 14*b* adapted to be engaged with the dowel pins 10*b* of the plate 10**.

Reference numeral 16 designates a subtrate for mounting a choke coil, a capacitor, etc. (not shown) constituting a network for dividing a frequency divided frequencies to the tweeter 1 and the woofer 2. The substrate 16 is formed at its central portion with a hole 16*a* adapted to be aligned to the central reamed hole 10*a* of the plate 10. The substrate 16 is further formed at its annular portion around the central hole 16*a* with a plurality of engagement holes 16*b* adapted to be engaged with the dowel pins 10*b* of the plate 10.

The substrate 16 and the frame 14 are superimposed on the plate 10 in this order in such manner that the central holes 16*a* and 14*a* are aligned to the central reamed hole 10*a* and that the engagement holes 16*b* and 14*b* are engaged with the dowel pins 10*b*. Thereafter, the dowel pins 10*b* are caulked to the frame 14 at the engagement holes 14*b*.

In this manner, the frame 14 is fixedly mounted on the plate 10, and simultaneously the substrate 16 on which the network is mounted is fixedly sandwiched between the plate 10 and the frame 14.

As shown in FIG. 1, the frustoconical frame 14 is formed at its conical portion with a plurality of window openings 14*c* and resultantly with a plurality of radially extending parting portions 14*d* each being formed between the adjacent window openings 14*c*. Accordingly, there is defined a large space between the substrate 16 and a damper 17 for supporting the voice coil 12, so that the network having a large number of parts such as octave 12 dB may be mounted on the substrate 16.

Referring to FIG. 1, reference numeral 16*c* designates an input terminal mounted to the substrate 16, and reference numeral 16*d* designates a repeating terminal as an output terminal of the network.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In a coaxial type speaker including a woofer having a diaphragm, a center pole for forming a magnetic circuit of said woofer, and a tweeter mounted on a front end of said center pole; a network mounting device comprising frame for supporting an outer circumference of said diaphragm of said woofer, a plate for forming said magnetic circuit, a network for dividing a frequency and feeding divided frequencies to said woofer and said tweeter, and a substrate for mounting said network thereon, said subtrate being sandwiched between said frame and said plate.

2. The network mounting device as defined in claim 1, wherein said plate for forming said magnetic circuit of said woofer is formed at its central portion with a reamed hole so as to define a magnetic gap between said center pole and said plate, and is formed at its annular portion around said central portion with a plurality of dowel pins projecting from a front surface of said plate.

3. The network mounting device as defined in claim 2, wherein said frame and said substrate are formed with central holes adapted to be aligned to said reamed hole of said plate, and are also formed with a plurality of engagement holes adapted to be engaged with said plural dowel pins of said plate.

4. The network mounting device as defined in any one of claims 1 to 3, wherein said frame is formed at its annular portion with a plurality of window openings and a plurality of radially extending parting portions for parting said window openings.

5. The network mounting device as defined in claim 3, wherein said dowel pins of said plate may be caulked to said frame.

* * * * *